US009176437B2

(12) United States Patent
Umetsu

(10) Patent No.: US 9,176,437 B2
(45) Date of Patent: Nov. 3, 2015

(54) IMAGE FORMING APPARATUS AND TEMPERATURE CONTROLLER FOR FORMING DECOLORABLE IMAGES

(71) Applicants: KABUSHIKI KAISHA TOSHIBA, Tokyo (JP); TOSHIBA TEC KABUSHIKI KAISHA, Tokyo (JP)

(72) Inventor: Toshiyuki Umetsu, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/224,336

(22) Filed: Mar. 25, 2014

(65) Prior Publication Data

US 2015/0277305 A1 Oct. 1, 2015

(51) Int. Cl.

| | |
|---|---|
| ***G03G 15/20*** | (2006.01) |
| ***G03G 15/01*** | (2006.01) |
| ***B41M 7/00*** | (2006.01) |
| *G03G 9/09* | (2006.01) |

(52) U.S. Cl.

CPC ..... *G03G 15/2039* (2013.01); *B41M 7/0009* (2013.01); *G03G 15/0105* (2013.01); *G03G 9/0926* (2013.01)

(58) Field of Classification Search

CPC ..... G03G 15/2039; G03G 9/0926; B41M 7/0009

See application file for complete search history.

(56) References Cited

U.S. PATENT DOCUMENTS

| | | | | |
|---|---|---|---|---|
| 5,394,231 | A * | 2/1995 | Sudo et al. | 399/228 |
| 2008/0003019 | A1 | 1/2008 | Kikuchi | |
| 2008/0261143 | A1 | 10/2008 | Yamashita | |
| 2009/0154970 | A1 * | 6/2009 | Yoshida et al. | 399/341 |
| 2010/0290812 | A1 * | 11/2010 | Taguchi et al. | 399/223 |
| 2011/0165509 | A1 * | 7/2011 | Aoki et al. | 430/124.1 |
| 2012/0141154 | A1 | 6/2012 | Yoshida | |
| 2012/0275803 | A1 * | 11/2012 | Taguchi et al. | 399/39 |
| 2012/0321350 | A1 | 12/2012 | Ogasawara | |
| 2012/0327154 | A1 * | 12/2012 | Mimura | 347/19 |
| 2014/0204169 | A1 * | 7/2014 | Kashiwagi | 347/179 |
| 2014/0210930 | A1 * | 7/2014 | Umetsu | 347/179 |
| 2014/0333706 | A1 * | 11/2014 | Imamiya | 347/179 |

* cited by examiner

*Primary Examiner* — G. M. Hyder

(74) *Attorney, Agent, or Firm* — Patterson & Sheridan, LLP

(57) ABSTRACT

An image forming apparatus according to an embodiment includes an image forming unit configured to form an image on a sheet using a plurality of decolorable color toners, wherein the decolorable color toners each have a preset fixing temperature and a preset decoloring temperature higher than the corresponding preset fixing temperature. The image forming apparatus further comprises a fixing unit configured to heat and apply pressure to the sheet having the image formed thereon to fix the image on the sheet, and a fixing temperature controller configured to control a fixing temperature of the fixing unit to be higher than or equal to a highest temperature among each of the preset fixing temperatures and to be lower than each of the preset decoloring temperatures.

17 Claims, 10 Drawing Sheets

| | FIXING TEMPERATURE | DECOLORING TEMPERATURE |
|---|---|---|
| YELLOW (Y) | 100°C | 140°C |
| MAGENTA (M) | 110°C | 145°C |
| CYAN (C) | 105°C | 150°C |
| BLACK (K) | 130°C | 155°C |

FIG. 7

| | FIXING TEMPERATURE | DECOLORING TEMPERATURE |
|---|---|---|
| YELLOW (Y) | 100°C | 120°C |
| MAGENTA (M) | 110°C | 145°C |
| CYAN (C) | 105°C | 150°C |
| BLACK (K) | 130°C | 155°C |

FIG. 8

| | FIXING TEMPERATURE | DECOLORING TEMPERATURE |
|---|---|---|
| YELLOW (Y) | 100°C | 140°C |
| MAGENTA (M) | 110°C | 145°C |
| CYAN (C) | 105°C | 150°C |
| BLACK (K) | 130°C | 155°C |

IMAGE FORMING APPARATUS AND TEMPERATURE CONTROLLER FOR FORMING DECOLORABLE IMAGES

FIELD

Embodiments described herein relate generally to a fixing temperature and a decoloring temperature when a color image is formed using a decolorable toner.

BACKGROUND

Conventionally, when an image is formed using a decolorable toner, a decolorable toner of a single color is used. If an image is formed using a plurality of decolorable color toners, a problem occurs. When a fixing temperature of one of the plurality of decolorable color toners is higher than a decoloring temperature of another of the plurality of decolorable color toners and all of the decolorable color toners are fixed on a sheet, a part of the image formed of decolorable color toners is decolored.

DESCRIPTION OF THE DRAWINGS

FIG. 7 is diagram illustrating a relationship between fixing temperatures and decoloring temperatures of a plurality of decolorable color toners.

FIG. 8 is another diagram illustrating a relationship between fixing temperatures and decoloring temperatures of the plurality of decolorable color toners.

DETAILED DESCRIPTION

Figure 1:
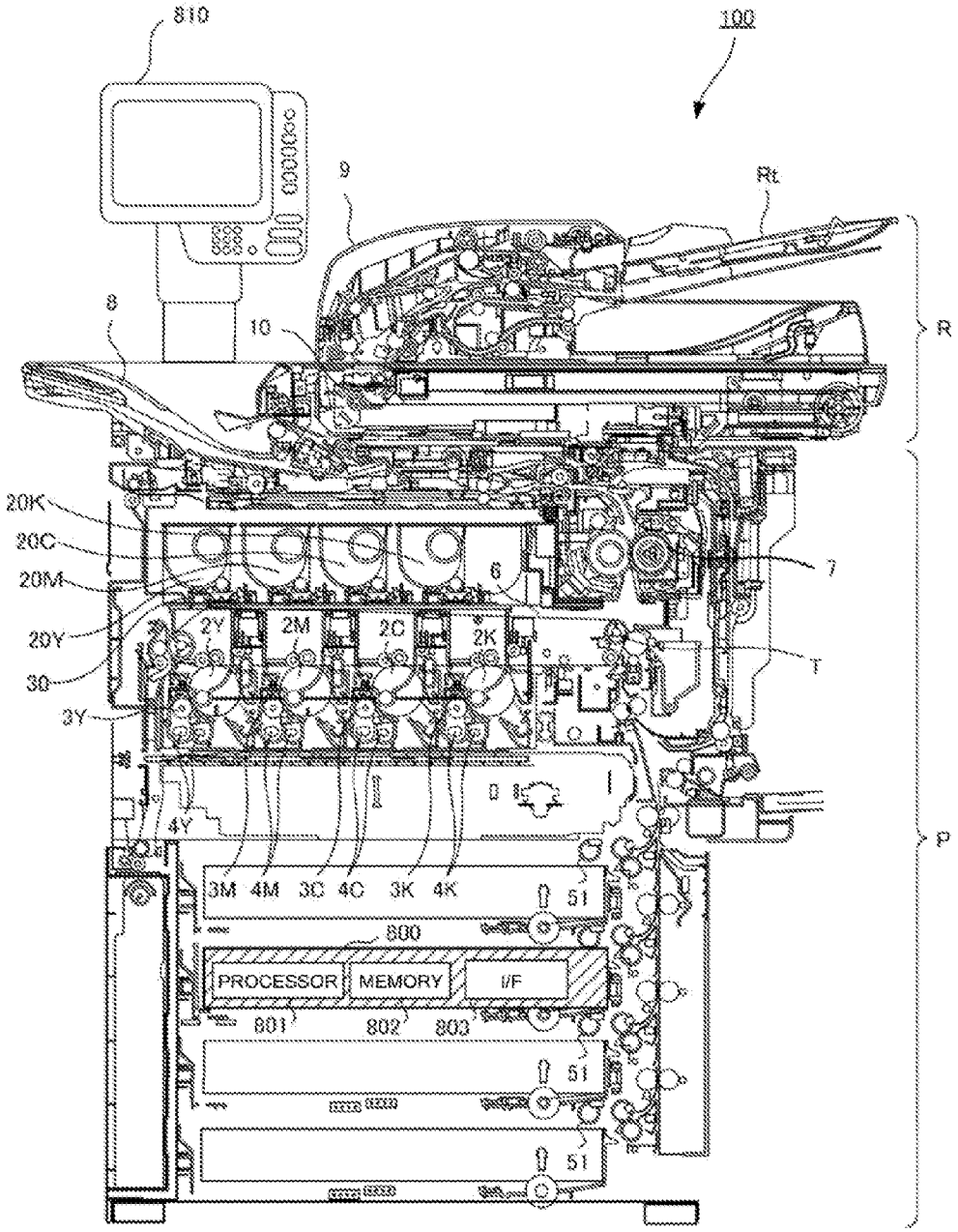
FIG. 1 is a schematic diagram illustrating a configuration of an image forming apparatus according to an embodiment.

An image forming apparatus according to an embodiment includes an image forming unit configured to form an image on a sheet using a plurality of decolorable color toners, wherein the decolorable color toners each have a preset fixing temperature and a preset decoloring temperature higher than the corresponding preset fixing temperature. The image forming apparatus further comprises a fixing unit configured to heat and apply pressure to the sheet having the image formed thereon to fix the image on the sheet, and a fixing temperature controller configured to control a fixing temperature of the fixing unit to be higher than or equal to a highest temperature among each of the preset fixing temperatures and to be lower than each of the preset decoloring temperatures.

The embodiment relates to the image forming apparatus which can form an image using a plurality of decolorable toners.

When the fixing temperature of the fixing unit in the image forming apparatus is higher than or equal to the preset decoloring temperatures of the plurality of decolorable toners, a decolorable toner which is fixed at a decoloring temperature thereof or higher is decolored.

Therefore, in order to fix all the decolorable color toners on a sheet, it is necessary that the fixing temperature of the fixing unit be set to be higher than or equal to the highest temperature among all the preset fixing temperatures of the plurality of decolorable color toners and to be lower than all the preset decoloring temperatures of the plurality of decolorable color toners.

Hereinafter, the embodiment will be described referring to the drawings.

FIG. 1 is a vertical cross-sectional view illustrating a schematic configuration of an image forming apparatus 100 according to an embodiment. The image forming apparatus 100 may be, for example, a Multi-Function Peripheral (MFP). As illustrated in FIG. 1, the image forming apparatus 100 includes a reading unit R and an image forming unit P.

The reading unit R scans images of a sheet document or a book document to be read. The reading unit R includes an optical scanning system 10 and an auto document feeder 9 (ADF). The optical scanning system 10 includes a plurality of reflective mirrors and imaging devices. The auto document feeder 9 can automatically feed a document to a predetermined placement position. An image of a document which is automatically fed by the auto document feeder 9 is read by the optical scanning system 10 and placed on a document tray Rt. Alternatively, an image of a document which is placed on a platen (not illustrated) is read by the optical scanning system 10.

The image forming unit P forms a developer image on a sheet, for example, based on an image which is read from a document by the reading unit R or image data which is transmitted from an external apparatus to the image forming apparatus 100. In addition, the image forming unit P includes photoreceptors 2Y to 2K, developing rollers 3Y to 3K, mixers 4Y to 4K, an intermediate transfer belt 6, a fixing unit 7, a discharge tray 8, toner cartridges 20Y to 20K, and a cartridge housing 30.

The image forming apparatus 100 includes a processor 801, a memory 802, and a communication interface (I/F) 803. The processor 801 is an arithmetic processing unit such as a central processing unit (CPU) or a micro processing unit (MPU). The processor 801 serves to execute various processes in the image forming apparatus 100, and loads and executes programs, which are prestored in the memory 802, to implement various functions.

The memory 802 is a storages which is configured by a random access memory (RAM) as a main storage and a non-volatile storage medium such as a flash memory or a hard disk drive. The communication I/F 803 is a unit which controls data transmission and reception with an external apparatus.

In addition, the image forming apparatus 100 includes a control panel 810. The control panel 810 includes a touch panel type input unit that receives an instruction from a user. The control panel 810 also includes a flat type display that displays processing details, messages, and the like to a user and displays a preview image of a printing target before printing.

Hereinafter, a copying process will be briefly described as an example of a process in the image forming apparatus 100 according to the embodiment. First, a sheet picked up by a pick-up roller 51 is supplied inside a sheet carrying path. The sheet which is supplied inside the sheet carrying path is carried toward a predetermined carrying direction by a plurality of roller pairs.

Images of a plurality of sheet documents which are continuously and automatically fed by the auto document feeder 9 are read by the optical scanning system 10.

Next, a control board 800 performs predetermined image processing on image data which is read from a document by the reading unit R. Then, electrostatic latent images of the image-processed data are formed on surfaces of the photoreceptors 2Y, 2M, 2C, and 2K in order to transfer developer images of yellow (Y), magenta (M), cyan (C), and black (K) onto a sheet.

Next, developers which are stirred by the mixer 4Y to 4K in developing units are supplied to the photoreceptor 2Y to 2K, on which the electrostatic latent images are formed as described above, by developing rollers (so-called, magnet rollers) 3Y to 3K. As a result, the electrostatic latent images which are formed on the surfaces on the photoreceptors are developed.

The developer images which are formed on the photoreceptors are transferred (e.g., primary transfer) onto a surface of the intermediate transfer belt 6. The developer images which are carried by the rotation of the intermediate transfer belt are transferred onto a sheet which is carried at a predetermined secondary transfer position T.

The developer images which are transferred onto the sheet are fixed on the sheet by the fixing unit 7 at a fixing temperature, discussed further below. The sheet on which the developer images are fixed is transferred inside a sheet carrying path by a plurality of carrying rollers and is sequentially discharged onto the discharge tray 8.

A printing process is the same as the above-described operation, except that printing target data which is transmitted from a computer is acquired through the communication I/F 803.

Figure 2:
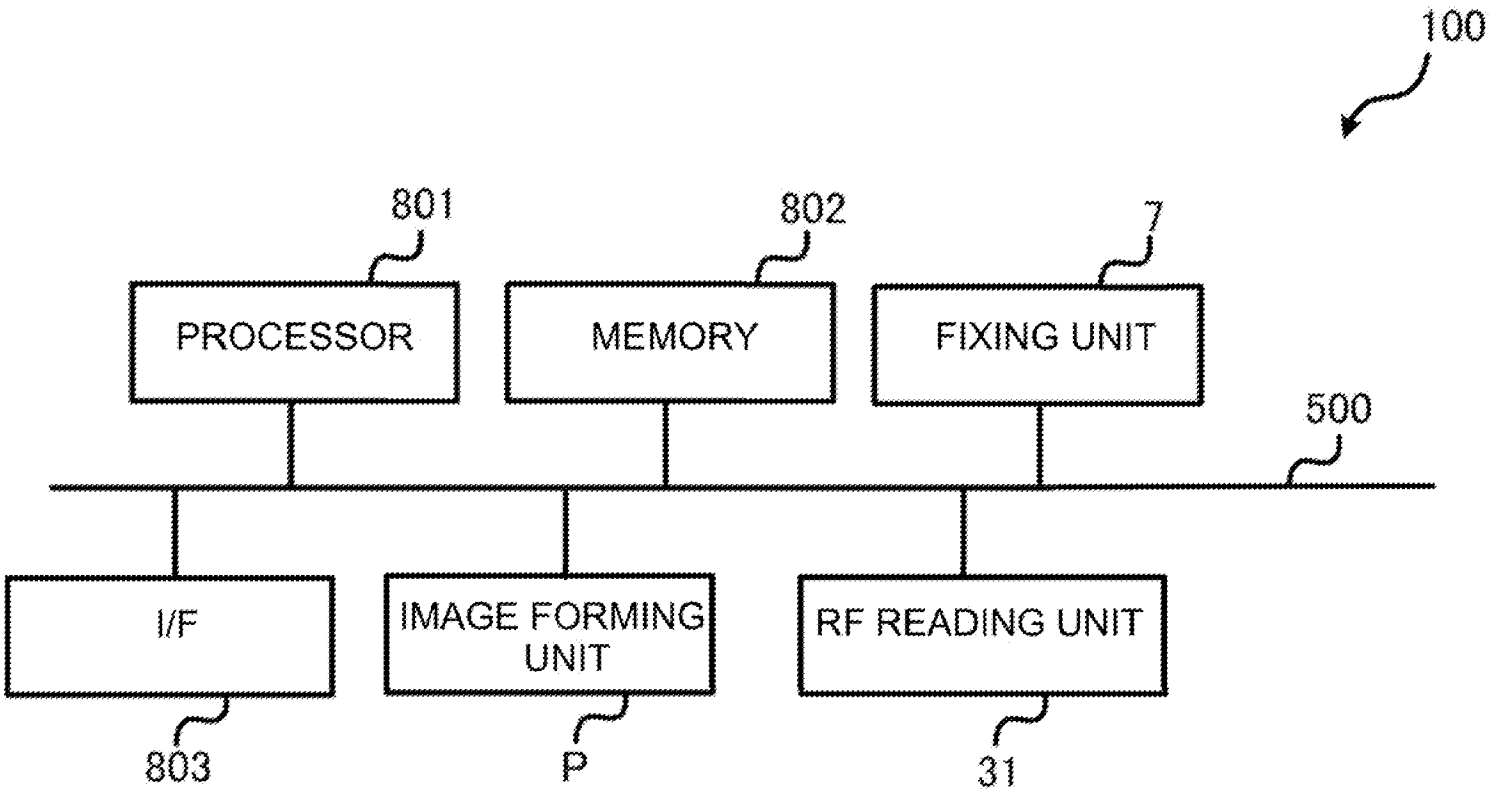
FIG. 2 is a control block diagram illustrating a configuration of the image forming apparatus.

FIG. 2 is a control block diagram illustrating a configuration of the image forming apparatus 100. In FIG. 2, the processor 801 controls the entire image forming apparatus 100. The processor 801, the memory 802 that reads printing data and the like, the communication I/F 803, the fixing unit 7, the image forming unit P, and a RF reading unit 31 are connected to each other through a bus line 500.

Figure 3:
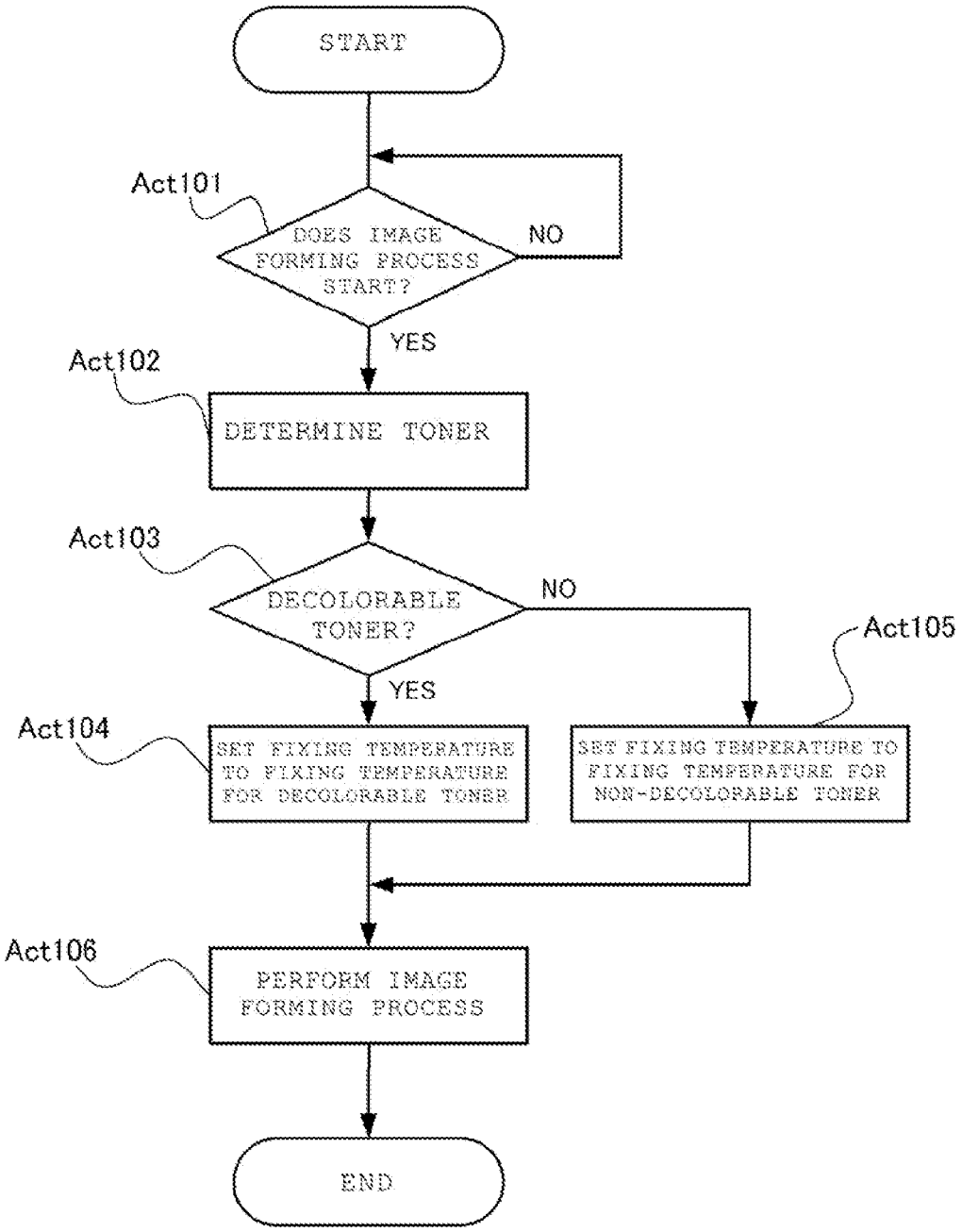
FIG. 3 is a flowchart illustrating a sequence of operations of the image forming apparatus.

FIG. 3 is a flowchart illustrating an image forming operation of the image forming apparatus 100.

Referring to FIGS. 2 and 3, the image forming operation of the image forming apparatus 100 will be described.

In Act 101, if the processor 801 receives an instruction to start the image forming process (Act 101, Yes), the process proceeds to Act 102. On the other hand, in Act 101, if the processor 801 does not receive an instruction to start the image forming process, the process does not proceed to Act 102 and instead waits for an instruction to start the image forming process. As the case where the processor 801 receives an instruction to start the image forming process, for example, there is a case where a user selects the start of the image forming process by inputting an operation through the control panel 810.

In Act 102, the processor 801 acquires information for determining whether a toner contained in a cartridge 20 is decolorable or not and determines the toner is decolorable or not.

A method of allowing the processor 801 to determine whether the toner contained in the cartridge is a decolorable toner or a non-decolorable toner will be described in detail using FIGS. 4 to 6.

The image forming unit P of the image forming apparatus 100 can form an image on a sheet using any of a plurality of kinds of decolorable toners that are thermally decolorable and a plurality of kinds of non-decolorable toners that are not thermally decolorable As the method of determining whether the toner contained in the cartridge 20 is a decolorable toner or a non-decolorable toner, for example, a determination method using radio frequency identification (RFID) can be adopted. Hereinafter, in the embodiment, the method of determining whether the toner is decolorable or not will be described as the determination method using RFID.

Figure 4:
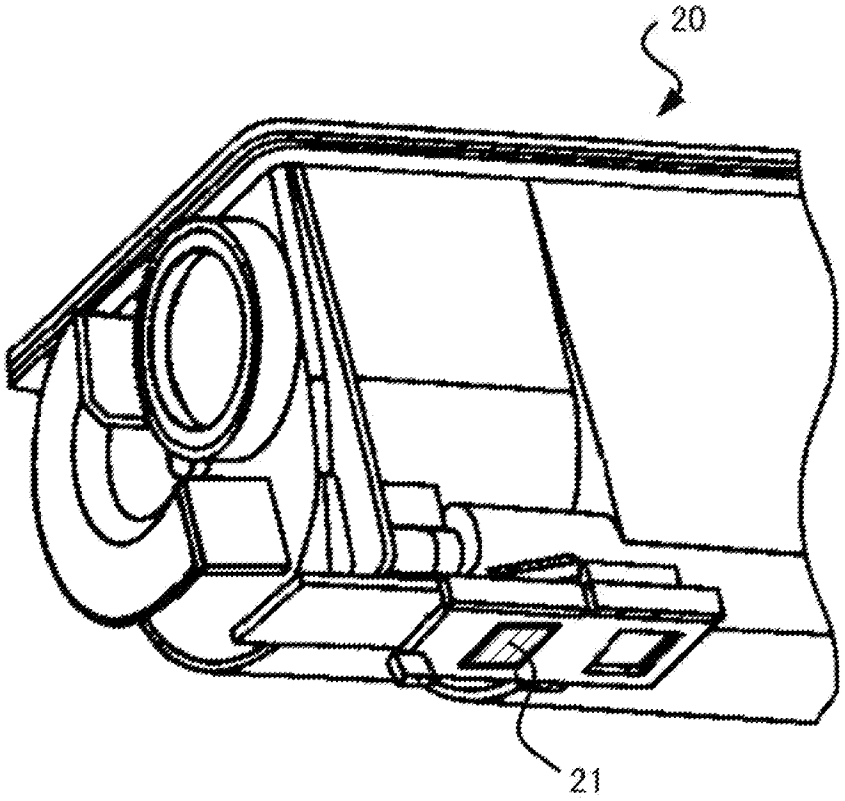
FIG. 4 is a perspective view illustrating a toner cartridge for use in the image forming apparatus.

FIG. 4 is a perspective view illustrating the cartridge 20 that contains a toner. The cartridge 20 contains a toner. The cartridge 20 may be a yellow cartridge 20Y, a magenta cartridge 20M, a cyan cartridge 20C, or a black cartridge 20K. The cartridge 20 includes an RF tag 21 at the bottom. Hereinafter, a reference to cartridge 20 refers generically to one of the cartridges 20Y to 20K.

Figure 5:
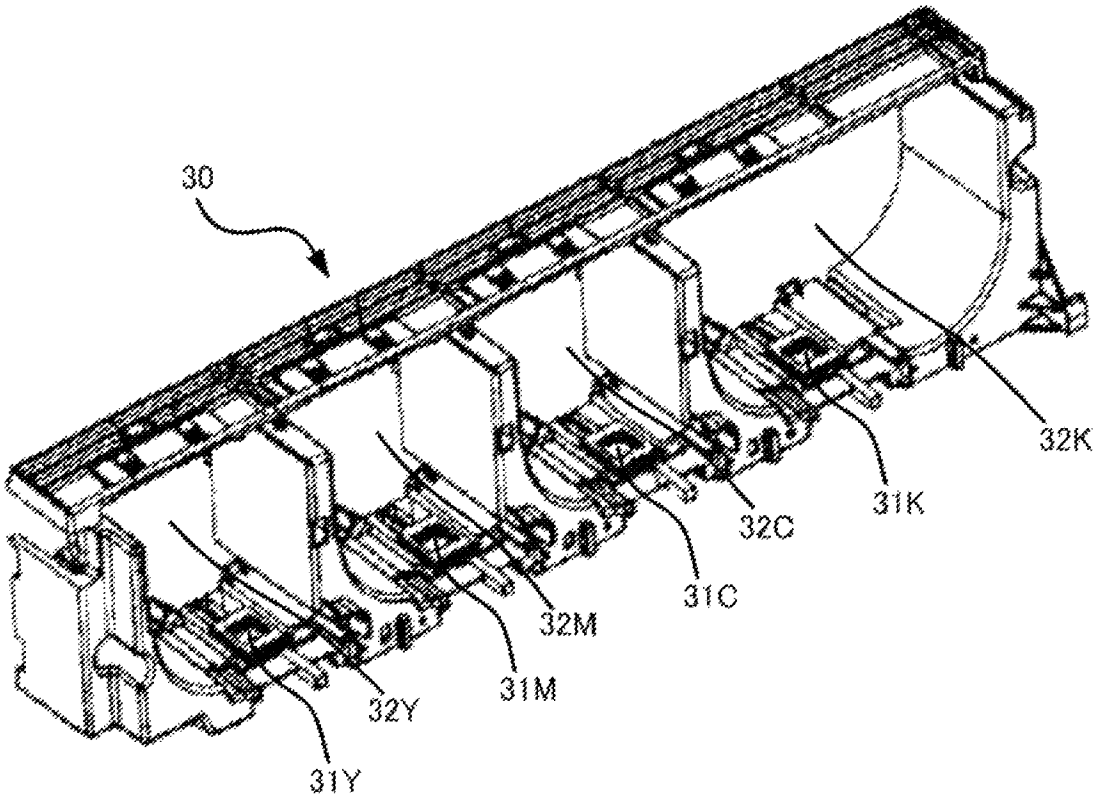
FIG. 5 is a perspective view illustrating a cartridge housing for use in the image forming apparatus.

FIG. 5 is a perspective view illustrating a cartridge housing 30 that houses each of the cartridges 20, i.e., cartridges 20Y to 20K. The cartridge housing 30 includes RF reading units 31Y to 31K in openings 32Y to 32K through which the cartridges 20Y to 20K are housed in the cartridge housing 30.

Figure 6:
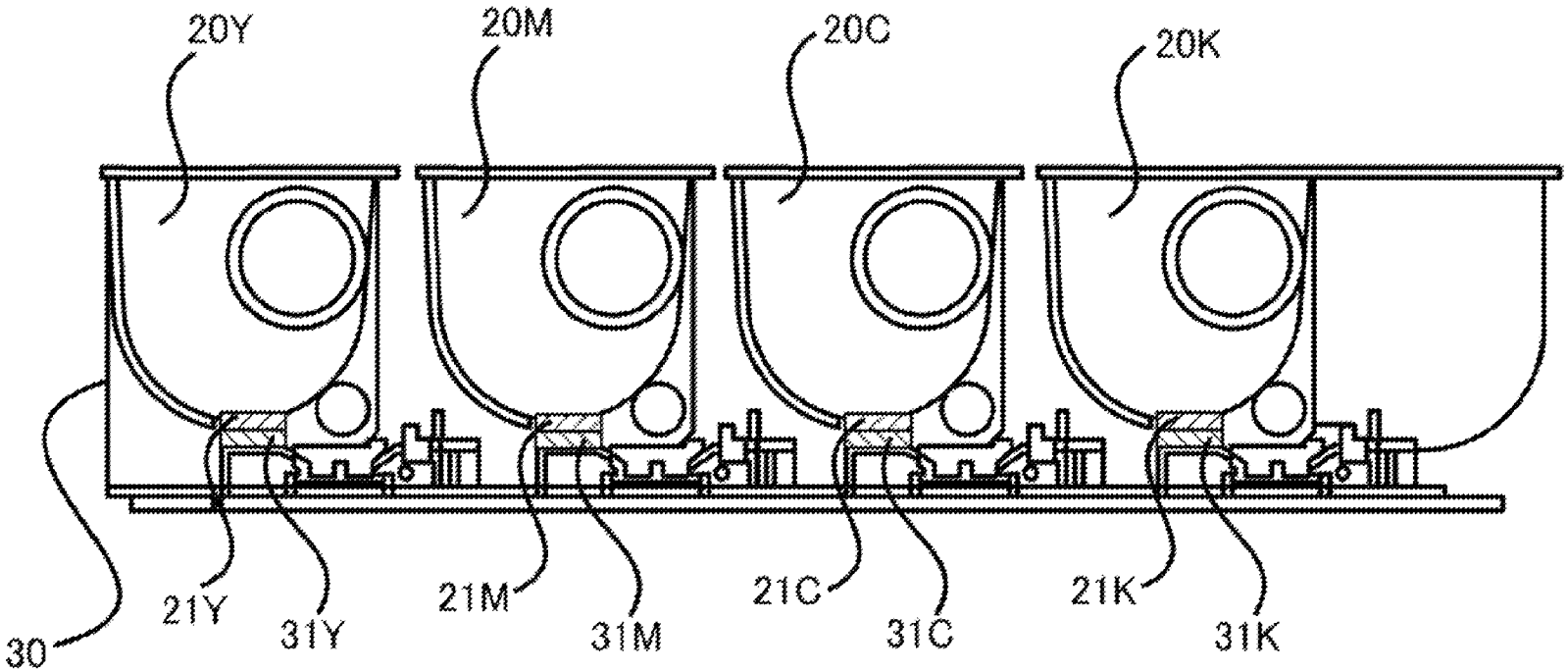
FIG. 6 is a front view of the cartridge housing with the toner cartridges installed.

FIG. 6 is a diagram illustrating a state where each of the cartridges 20Y to 20K are housed in the cartridge housing 30.

When the cartridge 20 is housed in the cartridge housing 30, the RF tag 21 included in the cartridge 20 is positioned at a position overlapping the RF reading unit 31 (RF reader). By the processor 801 controlling the RF reading unit 31 (RF reader), the RF reading unit 31 acquires the determination information whether the toner contained in the cartridge 20 is decolorable or not from the RF tag 21 (RF tag). Then, the processor 801 acquires the determination information whether the toner is decolorable or not from the RF reading unit 31.

As the method of determining whether the toner contained in the cartridge 20 is decolorable or not, in addition to the method of acquiring the determination information which is stored in the RF tag provided in the cartridge of the toner, from the tag reader, other methods may be used. For example, the determination information may be acquired by reading a barcode, which is attached to a cartridge of a toner or an ink, with a barcode reader. The determination information may also be acquired by detecting convex and concave portions, which are formed in a cartridge of a toner or an ink, through a switch or the like provided in a main body of the image forming apparatus 100. Of course, the determination method is not limited to the above-described automatic detection. The kind of the toner which is a fixing target can also be determined by a user inputting an operation through a user interface or the like.

Returning to FIG. 3, in Act 103, if the toner contained in the cartridge 20 is a decolorable toner (Act 103, Yes), the process proceeds to Act 104. On the other hand, in Act 103, if the toner contained in the cartridge 20 is a non-decolorable toner (Act 103, No), the process proceeds to Act 105.

In Act 104, by the processor 801 controlling the fixing unit 7, the fixing temperature of the fixing unit 7 is set to a fixing temperature for a decolorable toner.

In Act 105, by the processor 801 controlling the fixing unit 7, the fixing temperature of the fixing unit 7 is set to a fixing temperature for a non-decolorable toner.

In Act 106, by the processor 801 controlling the image forming apparatus 100, the image forming apparatus 100 performs the image forming process. As described above, the image forming apparatus 100 forms an image on a sheet.

Here, the fixing temperature for a decolorable toner which is described in Act 104 will be described in detail.

FIGS. 7 and 8 are diagrams illustrating a relationship between fixing temperatures and decoloring temperatures of a plurality of decolorable toners.

For example, in FIG. 7, the fixing temperature of a black (K) toner is 130° C., which is higher than the decoloring temperature of a yellow (Y) toner of 120° C. In this case, if all the decolorable color toners of yellow (Y), magenta (M), cyan (C), and black (K) are fixed on a sheet, it is necessary that the toners be fixed at a temperature of 130° C. or higher. If all the color toners are fixed at 130° C., the decolorable yellow (Y) toner is decolored because the decoloring temperature of the decolorable yellow (Y) toner is 120° C. Accordingly, as illustrated in FIG. 8, it is necessary that the fixing temperature of the fixing unit 7 be set to be lower than all the preset decoloring temperatures of the plurality of decolorable color toners of yellow (Y), magenta (M), cyan (C), and black (K).

That is, in order to fix all the decolorable color toners on a sheet, it is necessary that the fixing temperature of the fixing unit be set to be higher than or equal to the highest temperature among all the preset fixing temperatures of the plurality of decolorable color toners and to be lower than all the preset decoloring temperatures of the plurality of decolorable color toners.

Figure 9:
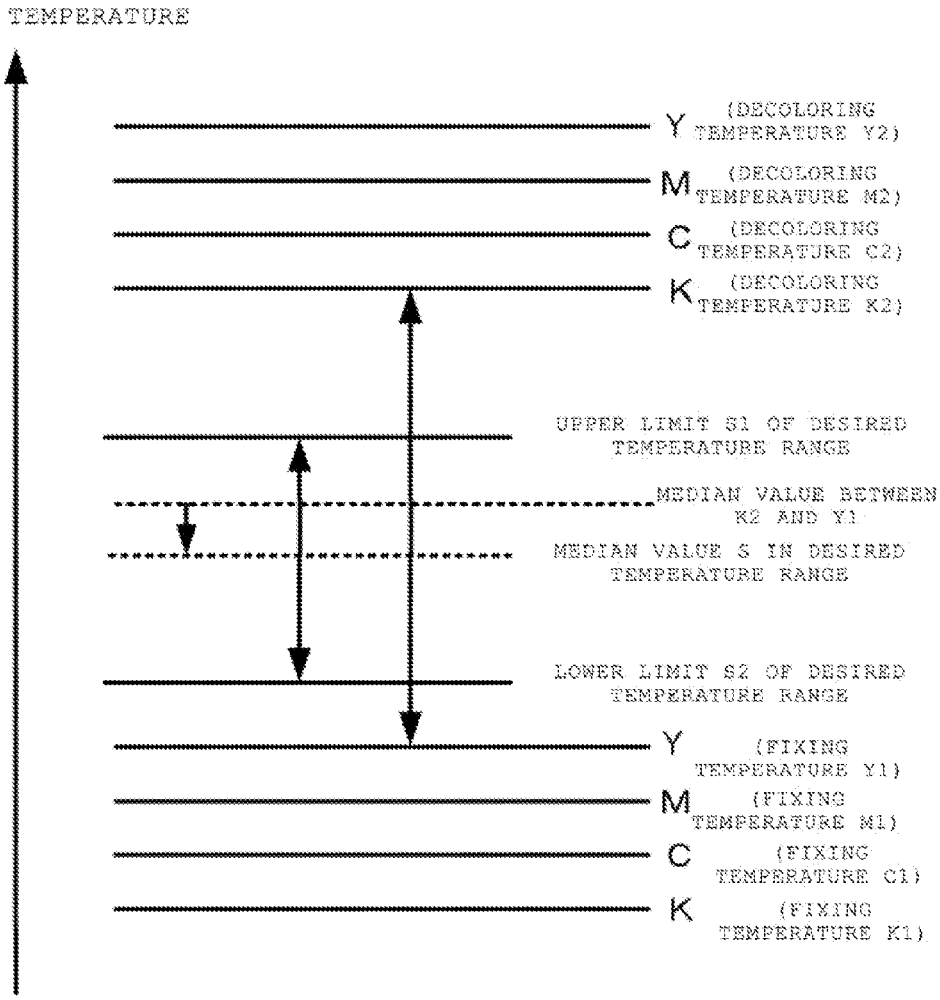
FIG. 9 is a diagram illustrating a relationship between a desired value of a fixing temperature and fixing temperatures and decoloring temperatures of the plurality of decolorable color toners, according to the embodiment.

FIG. 9 is a diagram illustrating a relationship between a desired value S of a fixing temperature; and fixing temperatures and decoloring temperatures of a plurality of decolorable color toners.

Regarding the fixing temperature of the fixing unit 7, a desired temperature is not controlled to a certain value and is instead set in a desired temperature range to control the fixing temperature. Here, the upper limit of the desired temperature range is set as S1, and the lower limit of the desired temperature range is set as S2.

If the upper limit S1 of the desired temperature range is set to be higher than all the preset decoloring temperatures of the plurality of decolorable color toners, a decoloring toner which is fixed at a decoloring temperature thereof or higher would be decolored. For example, in FIG. 9, if the upper limit S1 of the desired temperature range is higher than or equal to a decoloring temperature K2, the decolorable black toner would be decolored. If a decolorable toner which forms an image on a sheet is decolored, the image which is formed on the sheet is also decolored, which is undesirable.

Therefore, a median value S in the desired temperature range of the fixing temperature, which is controlled by the fixing temperature controller, can be set to be lower compared to a median value in a range from the highest temperature among all the preset fixing temperatures of the plurality of decolorable color toners to the lowest temperature among all the preset decoloring temperatures of the plurality of decolorable color toners.

As a result, a decolorable toner is prevented from being decolored by a control error of the fixing temperature.

In addition, as described above, in order to fix all the decolorable color toners on a sheet, it is necessary that the fixing temperature of the fixing unit be set to be higher than or equal to the highest temperature among all the preset fixing temperatures of the plurality of decolorable color toners and to be lower than all the preset decoloring temperatures of the plurality of decolorable color toners.

In the embodiment, the setting of the fixing temperature of the fixing unit 7 is not limited to the desired temperature range. For example, a desired value of the fixing unit 7 may be limited and set to a specific value. In this case, the specific value can be set to be lower than a median value in a range from the highest temperature among all the preset fixing temperatures of the plurality of decolorable color toners to a lowest temperature among all the preset decoloring temperatures of the plurality of decolorable color toners.

In this case, the particular decolorable color toner having the highest fixing temperature corresponds to a photoreceptor 2 which is positioned on the most upstream side in a moving direction of an image holding member (e.g., the intermediate transfer belt 6) among all the photoreceptors 2Y to 2K. Toner images are transferred onto the image holding member, and the photoreceptors correspond to the plurality of decolorable color toners in the image forming unit 100, respectively.

If the image forming apparatus uses an intermediate transfer belt 6, a toner corresponding to the photoreceptor 2, which is positioned on the most upstream side in a moving direction of the intermediate transfer belt 6, is positioned on the uppermost layer (layer which is most distant from a sheet) when being transferred onto a sheet. Since the fixing unit heats a sheet from the uppermost layer side of toners which are laminated on the sheet, a color toner which is positioned on the uppermost layer is more easily affected by heat as compared to a color toner which is positioned on the lowermost layer. Conversely, the color toner which is positioned on the lowermost layer is not easily affected by heat as compared to the color toner which is positioned on the uppermost layer. Therefore, typically, toners which are transferred onto a sheet are laminated thereon such that the fixing temperatures of the toners increase from the lowermost layer to the uppermost layer. That is, a toner having the highest fixing temperature among the plurality of decolorable color toners is laminated on the uppermost layer in many cases. Accordingly, if the fixing temperature of the fixing unit is set to be higher than the fixing temperature of a decolorable color toner corresponding to a photoreceptor which is positioned on the most upstream side in the moving direction of the transfer belt, all of the plurality of decolorable color toners can be easily fixed on the sheet.

In an image forming apparatus in which toner images are directly formed on a sheet without using an intermediate transfer belt, a decolorable color toner corresponding to the photoreceptor 2, which is positioned on the most downstream side in a sheet carrying direction, is positioned on the uppermost layer when being laminated on a sheet. Therefore, in the image forming apparatus not including an intermediate transfer belt, the fixing temperature of the fixing unit can be set to be higher than the fixing temperature of the decolorable color toner corresponding to a photoreceptor which is positioned on the most downstream side in the sheet carrying direction among all the photoreceptors, and the photoreceptors correspond to the plurality of decolorable color toners in the image forming unit, respectively.

Figure 10:
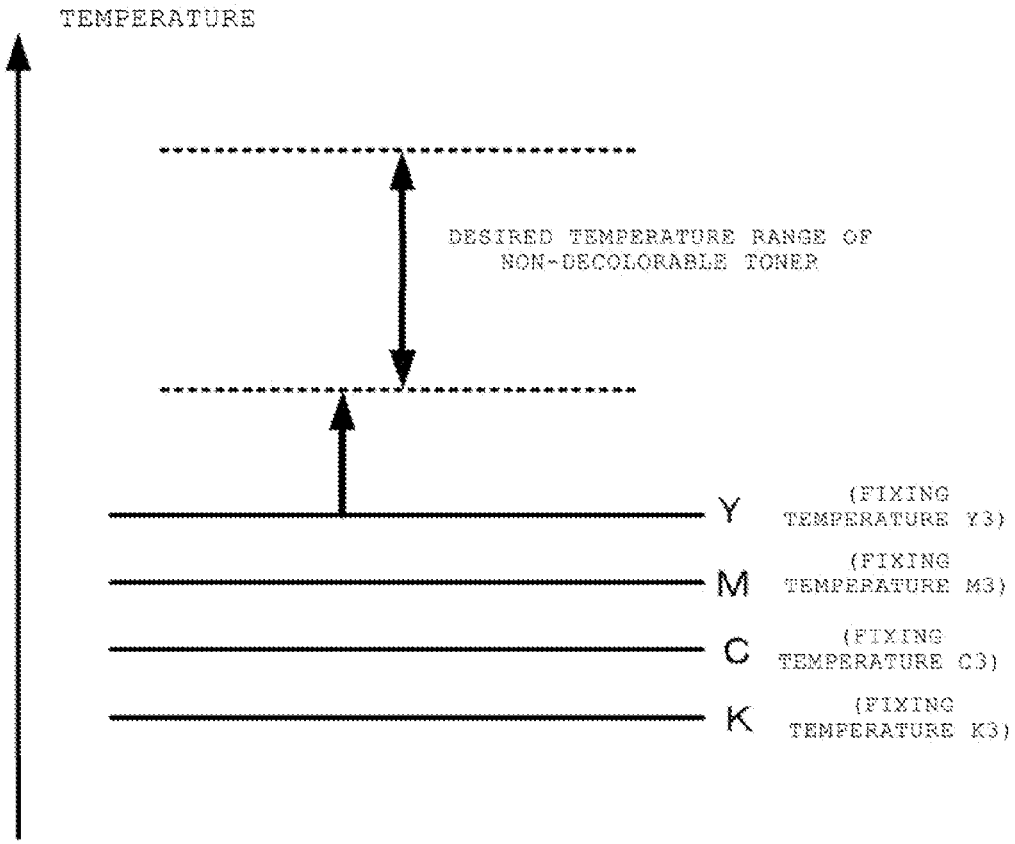
FIG. 10 is a diagram illustrating a relationship between a desired value of a fixing temperature and fixing temperatures of a plurality of non-decolorable color toners, according to the embodiment.

FIG. 10 is a diagram illustrating a relationship between a desired value S of a fixing temperature and fixing temperatures of the plurality of non-decolorable color toners.

As described above using FIG. 10, in order to fix all the plurality of non-decolorable color toners on a sheet, it is only necessary that the desired range of the fixing temperature of the fixing unit be controlled to be higher than or equal to a highest temperature among all the preset fixing temperatures of the plurality of kinds of non-decolorable color toners.

In the embodiment, the case where the functions are already stored inside the memory 802 of the image forming apparatus in advance is described, but the embodiment is not limited thereto. The same functions may be downloaded to the image forming apparatus through the network or may be installed on the image forming apparatus through a recording medium which stores the same functions. The recording medium may be any forms as long as the recording medium, such as CD-ROM, can store a program and is readable on the apparatus. In addition, functions which are installed or downloaded in advance may be performed in cooperation with an operating system (OS) or the like which is installed on the image forming apparatus.

As described above, according to the technique described in this disclosure, if an image is formed using a plurality of decolorable color toners, all these plurality of decolorable color toners can be fixed on a sheet without being decolored.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming unit configured to form an image on a sheet using a plurality of decolorable color toners, wherein the decolorable color toners each have a preset fixing temperature and a preset decoloring temperature higher than the corresponding preset fixing temperature;

a fixing unit configured to heat and apply pressure to the sheet having the image formed thereon to fix the image on the sheet; and a fixing temperature controller configured to control a fixing temperature of the fixing unit to be:

higher than or equal to a highest temperature among each of the preset fixing temperatures, lower than each of the preset decoloring temperatures, and within a temperature range having a mid-point value lower than a mid-point value of a range between the highest temperature among each of the preset fixing temperatures and the lowest temperature among each of the preset decoloring temperatures.

2. The image forming apparatus according to claim 1, wherein:

the image forming unit includes:

an image holding member onto which the image is formed for transfer to the sheet, and a plurality of photoreceptors, each corresponding to one of the plurality of decolorable color toners; and a photoreceptor among the plurality of photoreceptors, corresponding to the decolorable color toner having the highest preset fixing temperature, is positioned on the most upstream side in a moving direction of the image holding member relative to the other of the plurality of photoreceptors.

3. The image forming apparatus according to claim 1, wherein:

the image forming unit includes a plurality of photoreceptors, each corresponding to one of the plurality of decolorable color toners; and a photoreceptor among the plurality of photoreceptors, corresponding to the decolorable color toner having the highest preset fixing temperature, is positioned on the most downstream side in a moving direction of the image holding member relative to the other of the plurality of photoreceptors.

4. The image forming apparatus according to claim 1, further comprising a determination information acquiring unit configured to acquire information for determining the preset fixing temperature and preset decoloring temperature for each of the plurality of decolorable toners.

5. The image forming apparatus according to claim 4, wherein the determination information acquiring unit comprises an RFID reading unit.

6. The image forming apparatus according to claim 1, wherein the image forming unit is further configured to form an image on a sheet using a plurality of kinds of non-decolorable toners that are not thermally decolorable, each having a preset non-decolorable fixing temperature, and the image forming apparatus further comprises:

a determination information acquiring unit configured to acquire information for determining whether a toner supply cartridge that supplies toner for forming an image supplies a decolorable toner or a non-decolorable toner, and when it is determined that the toner cartridge supplies decolorable toner, based on the information acquired by the determination information acquiring unit, the fixing temperature controller controls the fixing temperature of the fixing unit to be higher than or equal to the highest temperature among each of the preset fixing temperatures and to be lower than each of the preset decoloring temperatures, and when it is determined that the toner cartridge supplies non-decolorable toner, based on the information acquired by the determination information acquiring unit, the fixing temperature controller controls the fixing temperature of the fixing unit to be higher than or equal to the highest temperature among each of the preset non-decolorable fixing temperatures.

7. The image forming apparatus according to claim 6, wherein the determination information acquiring unit comprises an RFID reading unit.

8. A method of controlling a fixing temperature in an image forming apparatus having an image forming unit configured to form an image on a sheet using a plurality of decolorable color toners, wherein the decolorable color toners each have a preset fixing temperature and a preset decoloring temperature higher than the corresponding preset fixing temperature, and a fixing unit configured to heat and apply pressure to the sheet having the image formed thereon to fix the image on the sheet, the method comprising:

determining a highest temperature among each of the preset fixing temperatures and the lowest temperature among each of the preset decoloring temperatures;

controlling a fixing temperature of the fixing unit to be higher than or equal to a highest temperature among each of the preset fixing temperatures and to be lower than each of the preset decoloring temperatures; and forming the image on the sheet using the plurality of decolorable color toners in order of the corresponding preset decoloring temperatures so that the decolorable color toner having the highest preset fixing temperature is laminated on the sheet on top of the other decolorable color toners.

9. The method according to claim 8, wherein the fixing temperature controller controls the fixing temperature to be within a temperature range having a mid-point value lower than a mid-point value of a range between the highest temperature among each of the preset fixing temperatures and the lowest temperature among each of the preset decoloring temperatures.

10. The method according to claim 8, further comprising:

acquiring information for determining the preset fixing temperature and preset decoloring temperature for each of the plurality of decolorable color toners.

11. The method according to claim 10, wherein the information is acquired with an RFID reading unit.

12. The method according to claim 8, further comprising:

fixing the image on the sheet with the fixing unit at the controlled fixing temperature.

13. A non-transitory computer readable medium for use in an image forming apparatus having an image forming unit configured to form an image on a sheet using a plurality of decolorable color toners, wherein the decolorable color toners each have a preset fixing temperature and a preset decoloring temperature higher than the corresponding preset fixing temperature, a fixing unit configured to heat and apply pressure to the sheet having the image formed thereon to fix the image on the sheet, and a processor, the computer readable medium allowing the processor to execute a process comprising:

acquiring information for determining the preset fixing temperature and preset decoloring temperature for each of the plurality of decolorable color toners; and controlling a fixing temperature of the fixing unit to be:

higher than or equal to a highest temperature among each of the preset fixing temperatures, lower than each of the preset decoloring temperatures, and within a temperature range having a mid-point value lower than a mid-point value of a range between the highest temperature among each of the preset fixing temperatures and the lowest temperature among each of the preset decoloring temperatures.

14. The non-transitory computer readable medium according to claim 13, wherein the information is acquired with an RFID reading unit.

15. The non-transitory computer readable medium according to claim 13, the process further comprising:

determining the controlled fixing temperature based on the acquired information.

16. The non-transitory computer readable medium according to claim 13, the process further comprising:

forming the image on the sheet using the plurality of decolorable color toners in order of the corresponding preset decoloring temperatures so that the decolorable color toner having the highest preset fixing temperature is laminated on the sheet on top of the other decolorable color toners.

17. The non-transitory computer readable medium according to claim 13, the process further comprising:

fixing the image on the sheet with the fixing unit at the controlled fixing temperature.

* * * * *